US006466517B1

(12) United States Patent
Kohl

(10) Patent No.: US 6,466,517 B1
(45) Date of Patent: Oct. 15, 2002

(54) GLOBAL TRAVEL CLOCK

(75) Inventor: Roland W. Kohl, Hong Kong (HK)

(73) Assignee: Kienzle Time HK Ltd., Kowloon (HK)

( * ) Notice: Subject to any disclaimer, the term of this patent is extended or adjusted under 35 U.S.C. 154(b) by 0 days.

(21) Appl. No.: 09/357,033

(22) Filed: Jul. 20, 1999

Related U.S. Application Data

(60) Provisional application No. 60/131,247, filed on Apr. 27, 1999.

(51) Int. Cl.[7] ..... G04N 19/22; G04N 19/24; G04N 25/00

(52) U.S. Cl. ..... 368/28; 368/21; 368/29; 368/223

(58) Field of Search ..... 368/21, 22, 28, 368/29, 82–84, 233, 239

(56) References Cited

U.S. PATENT DOCUMENTS 4,130,987 A * 12/1978 Schickedanz
4,316,272 A * 2/1982 Naito ..... 368/21
RE32,655 E 4/1988 Levine
4,768,178 A 8/1988 Conklin et al.
4,823,328 A 4/1989 Conklin et al.
5,058,085 A * 10/1991 Lawler ..... 368/28
5,068,838 A 11/1991 Klausner et al.
D363,227 S 10/1995 Seehr
5,671,192 A 9/1997 Schaffel
6,069,848 A * 5/2000 McDonald ..... 368/107

* cited by examiner

*Primary Examiner*—Vit Miska
(74) *Attorney, Agent, or Firm*—Armstrong Teasdale LLP

(57) ABSTRACT

A global travel clock including a calender week indicator and a plurality of global time indicators are described. In one embodiment, the clock displays a current time value including a calender week value, and global time indicators indicating a time phase in a particular country. More particularly, each global time indicator displays a daylight phase, a leisure phase, or a sleep phase.

18 Claims, 3 Drawing Sheets

GLOBAL TRAVEL CLOCK

CROSS REFERENCE TO RELATED APPLICATION

This application claims the benefit of U.S. Provisional Application No. 60/131,247, filed Apr. 27, 1999.

BACKGROUND OF THE INVENTION

This invention relates generally to a clock and, more particularly, to a global travel clock.

Recently a fundamental change has occurred in the operation of businesses. In the past, businesses served a local or region base of customers. More recently, businesses have begun to serve the needs of customers located throughout the world. As a result, business people communicate, using for example voice communications or electronic mail, with business associates in many different geographic locations and in many different times zones. In addition, the business traveler is traveling to these different locations while continuing to remain in contact with his or her home office.

In addition, businesses and individuals also utilize printed calenders for planning and implementation of production schedules and commitments. However, some businesses and individuals utilize a calender day value, others a calender month value, while still others utilize a calender week value. As a result, determining a common date for planning and implementation in business has become a complicated task.

Accordingly, it is desirable to provide a global travel clock which displays, at least a current time, date, and calender week value. In addition, it is desirable to display a time phase for various geographic locations.

BRIEF SUMMARY OF THE INVENTION

These and other objects may be attained by a global travel clock including a time display having a calender week indicator and a plurality of global time indicators. In one embodiment, the clock utilizes a time generation circuit connected to the time display to generate a current time in a current geographic location and a current calender week value. More specifically, the time generation circuit utilizes a real time clock to generate the current time, and a processor circuit which utilizes the current time to determine the calender week value and the time phases for various geographic locations. Particularly, the current time includes an hour, minute, second, day of the week, date, and year.

In addition, the clock utilizes the global time indicators to display time phases for various geographic locations. Particularly, each global time indicator, for each geographic location, indicates a leisure phase, work phase, or sleep phase.

The above described global travel clock provides a current time, date, and calender week value for the current geographic location. In addition, the clock displays a time phase for various geographic locations utilizing easy to read global time indicators.

DETAILED DESCRIPTION OF THE INVENTION

Figure 1:
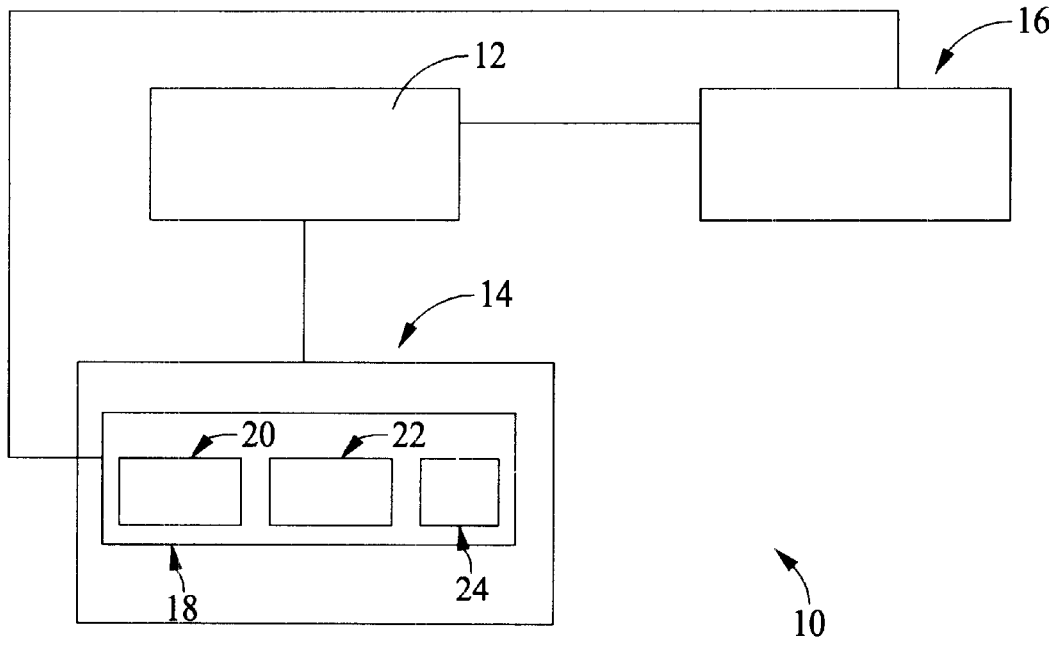
FIG. 1 is a block diagram of a global travel clock.

FIG. 1 illustrates a block diagram of a global travel clock 10 including a power source 12, for example, a battery, electrically connected to a time generation circuit 14. Clock 10 further includes a time display 16 electrically connected to time generation circuit 14 and power source 12.

In one embodiment, time generation circuit 14 includes a processor circuit 18 including a read only memory ("ROM") 20 and a random access memory ("RAM") 22. Processor circuit 18, for example, is a MTU 429 microprocessor made by Myson Technology of Taiwan. The MTU 429 microprocessor is a four bit processor and includes a 4 k ROM 20 and a 128 byte RAM 22. In addition, the MTU 429 includes a real-time clock 24 providing full date information including leap year correction and twenty-four hour time. More specifically, real-time clock 24 is configured to generate a current time including an hour, minute, second, day of the week, date, and year. In alternative embodiments, real time clock 24 may be a separate real-time clock circuit coupled to processor 18, as known in the art, to generate the current time for clock 10.

Processor circuit 18 is configured to determine a calender week ("KW") value, a current month, a current week, a current year, and time phases for various geographic locations utilizing the current time generated by RTC 24 and the data contained in ROM 20. Processor circuit 18 then transmits the current time value to time display 16. In one embodiment, ROM 20 contains data which includes KW values for a predetermined number of years, a plurality of offset times utilized in determining the current time in various geographic locations, a beginning day and an ending day for a calender week, a number of days in the calender week, a maximum number of days in a calender year, a number of typical calender weeks in the calender year, and a maximum number of calender weeks.

For example and in one embodiment, ROM 20 includes data having KW values, as described below, for every day of every year from 1999 to 2099. ROM 20 also includes data defining the beginning day and the ending day for the calender week. For example, ROM 20 includes data defining the beginning day as Sunday and the ending day as Saturday based upon a calender week system utilized in the Federal Republic of Germany. ROM 20 also includes data which defines the number of days in the calender week, for example, as seven. In one embodiment, ROM 20 also contains data which defines a majority of the number of days in the calendar week to be four days or greater.

Figure 2:
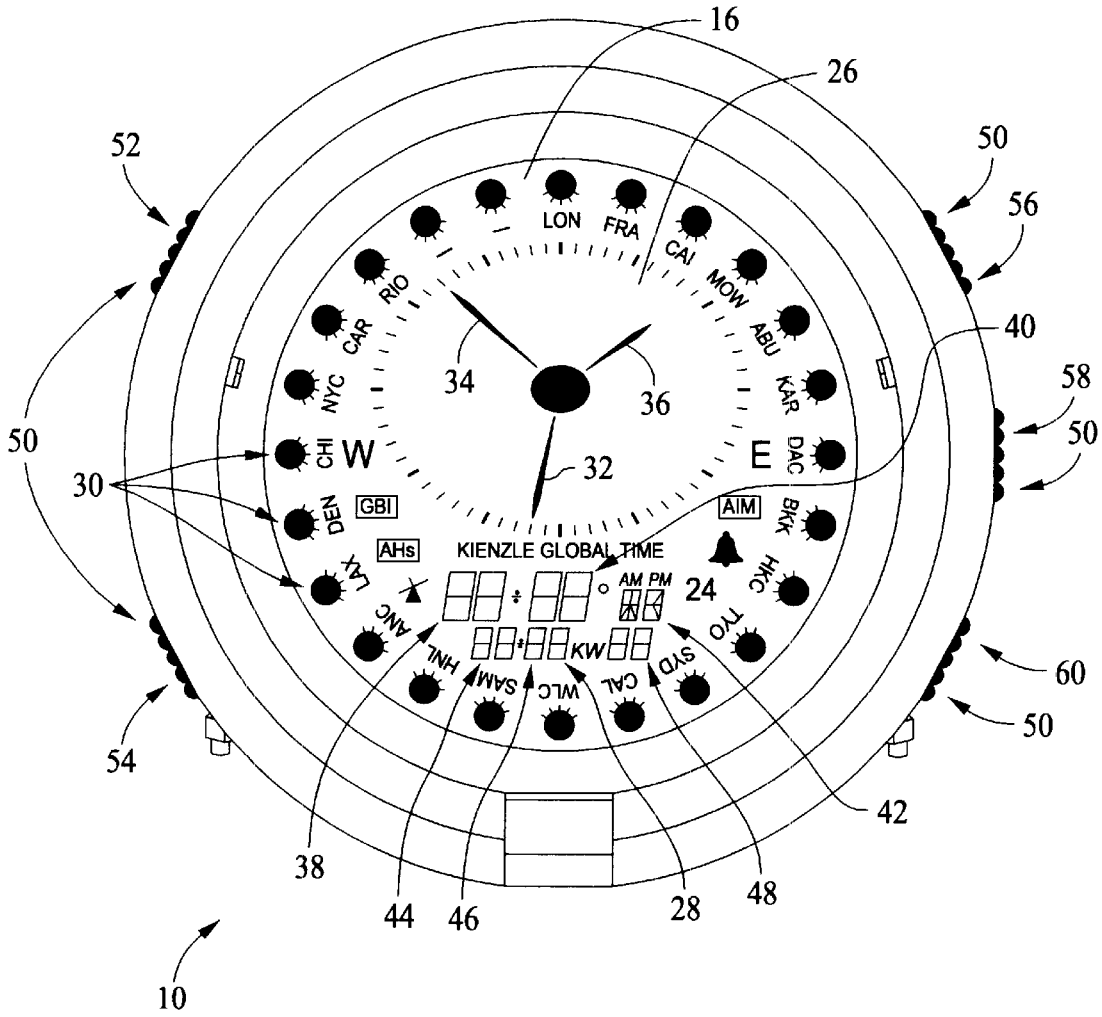
FIG. 2 is a view of the clock with a time display.

In one embodiment and as shown in FIG. 2, time display 16 includes an analog field 26 and a multi-function field 28 surrounded by a plurality of global time indicators 30. In one embodiment, analog field 26 includes an hour hand 32, a minute hand 34, and a second hand 36. In one embodiment, multi-function field 28 includes a first cell 38, a second cell 40, a third cell 42, a fourth cell 44, a fifth cell 46, and a sixth cell 48. Of course, analog field 26 and multi-function field 28 may have any number of respective hands and cells.

In one embodiment, display 16 includes global time indicators 30 for a plurality of geographic locations, for example, London, Frankfurt, Cairo, Moscow, Abu Dhabi, Karachi, Dhaka, Bangkok, Hong Kong, Tokyo, Sydney, New Caledonia, Wellington, Samoa, Honolulu, Anchorage, Los Angeles, Denver, Chicago, New York City, Caracas, and Rio De Janeiro, with each country's name, or abbreviation, adjacent each global time indicator 30.

Figure 3:
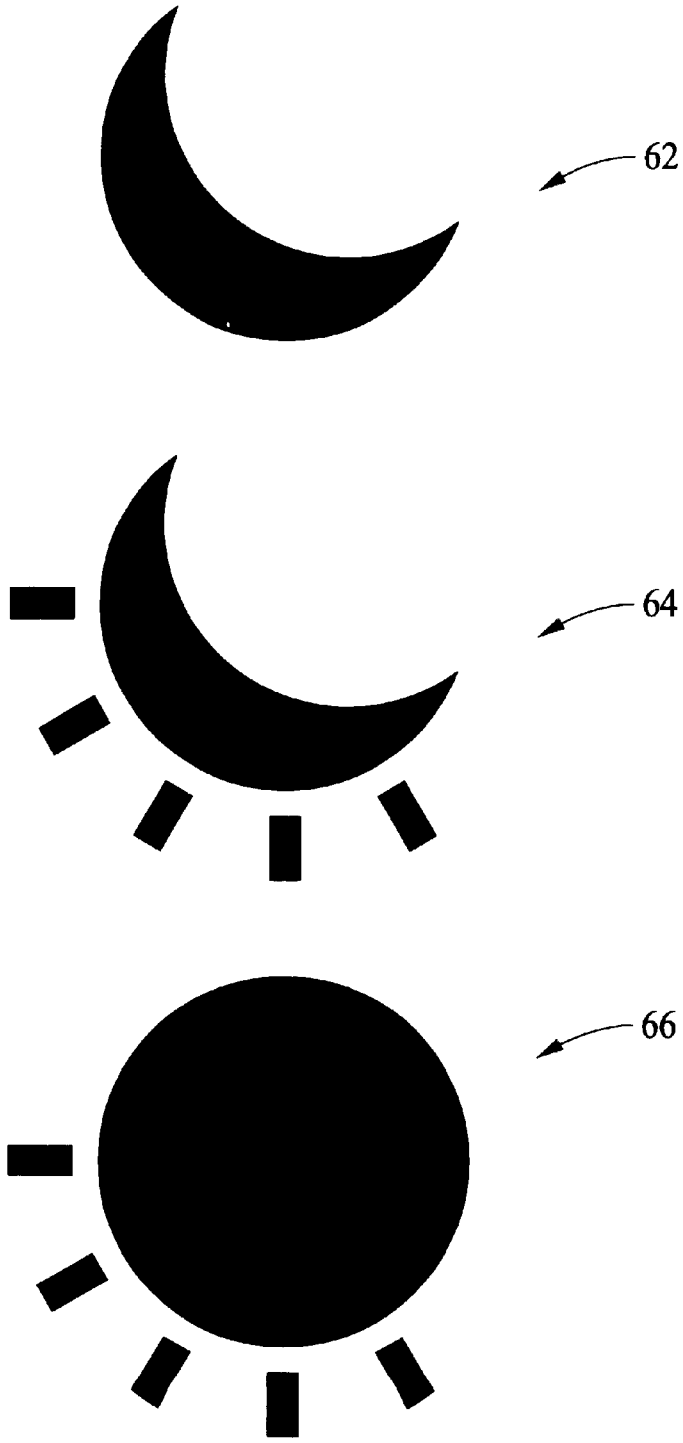
FIG. 3 is an enlarged view of a daylight phase, a leisure phase, and a sleep phase of a global time indicator.

More specifically and in one embodiment, as shown in FIG. 3, each global time indicator 30 displays, for a specific geographic location, either a sleep phase 62, a leisure phase 64, or a daylight phase 66 as determined by processor circuit 18. In one embodiment, sleep phase 62 is represented by a crescent moon, leisure phase 64 is represented by a crescent sun, while daylight phase 66 is represented by a full sun. Particularly and in one embodiment, each global time indicator 30 displays sleep phase 62 for a first time range, for example, between twelve post meridiem, or 24:00, and transitions into daylight phase 66 at eight ante meridiem, or 8:00. Daylight phase 66 is displayed for a second time range, for example, between eight ante meridiem and transitions into leisure phase 64 at seven post meridiem, or 19:00. Leisure phase 64 is displayed for a third time range, for example, between seven post meridiem and transitions into sleep phase 62 at twelve post meridiem.

Of course, various configurations of clock 10 may include any number of indicators 30 for various geographic locations and display sleep phase 62, leisure phase 64, or daylight phase 66 for different time ranges. In other embodiments, the specific design and shape of each global time indicator 30 may be altered.

Again referring to FIG. 2, clock 10 also includes a plurality of switches 50, more specifically and in one embodiment, clock 10 includes a set switch 52, a mode switch 54, an up-count/compensation and alarm on/off switch 56, a light/snooze switch 58, and a down-count/AM/PM/24 Hour/alarm set and Celsius/Fahrenheit switch 60. For example and in one embodiment, time display 16 is a liquid crystal display ("LCD").

In operation, prior to beginning use of clock 10, an operator or user obtains the current time for a current geographic location and alters the current time of clock 10 to reflect the current time. More specifically, the operator depresses set switch 52 to initialize the current time in RTC 24. The operator depresses up-count/compensation and alarm on/off switch 56 or down-count/AM/PM/24 Hour/alarm set and Celsius/Fahrenheit switch 60 to initialize the current hour, minute, second, day of the week, date, and year in RTC 24. Upon the completion of setting the time, the operator again depresses set switch 52 and RTC 24 begins incrementing the current time.

After initializing RTC 24, clock 10, specifically, time generation circuit 14, generates the current time for the current geographic location and various other geographic locations. Processor circuit 18 then utilizes the current time generated in time generation circuit 14 by RTC 24 and ROM 20 data to determine the KW value and a particular time phase for each global time indicator 30. In one embodiment, processor 18 utilizes the current time to determine, or locate, a respective KW value. Specifically and in one embodiment, the determination of the KW value is based on the data stored in ROM 20 defining a number of days remaining in the calender week for a calender year. In one embodiment utilizing a German calender system, if, after reaching 52 calendar weeks, a majority of days remaining in the current week are in the current calender year, the KW value for the current week is determined to be 53. If, however, the majority of days remaining in the calender week for the calender year are in a subsequent calender year, in the German calender week system, then the KW value is determined to be 1.

For example, where the current time is Sunday, Dec. 27, 1998, as determined by RTC 24, and the preceding week had a KW value of 52, processor circuit 18 determines that five days remain in the current year, as a result of five being a majority of days in the current calendar year, Sunday, Dec. 27, 1998 through Saturday, Jan. 2, 1999 has a KW value of 53. If, however, the current time generated by RTC 24 is Sunday, Dec. 31, 2000, processor circuit 18 determines that the KW value for the current time is 1 because the majority of the number of days remaining in the calender week are in the new calender year. Processor circuit 18 then utilizes ROM 20 to determine that Sunday, Dec. 31, 2000 through Saturday, Jan. 6, 2001 similarly has the KW value of 1.

In another embodiment, processor circuit 18 utilizes a reference value contained in ROM 20 along with the current time generated by RTC 24 to determine the KW value for the current time, particularly a current day. The reference value represents a beginning date, for example a modified Julian Calender date, for calculation of the KW value. The KW value for the current day is determined by an absolute difference between the current day and the reference value divided by the number of days in the calender week.

If the absolute difference between the current day and the reference value divided by the number of days in the calender week is not an integer, then the fractional remainder of the KW value is discarded and the resulting integer is the KW value for the current day. In one embodiment, if the absolute difference between the current day and the reference value divided by the number of days in the calender week is greater than 52, then processor circuit 18 utilizes data contained in ROM 20, the data having KW values for every $52^{nd}$ week and every $1^{st}$ week of every year from 1999 to 2099.

Clock 10 initially operates in a current time mode, with analog field 26 displaying a local time. First cell 38 displays a local current hour, second cell 40 displays a local current minute, while third cell 42 displays a local current second. Fourth cell 44 displays a local current day, while fifth cell 46 displays a local current month, and sixth cell 48 is blank. Upon a first depression of mode switch 54, clock 10 is switched to a day mode. In the day mode, first cell 38 displays the local current day, second cell 40 displays the local current month, third cell 42 displays a local weekday, fourth cell 44 and fifth cell 46 display a local year, and sixth cell 48 displays the KW value.

Upon a second depression of mode switch 54, clock 10 is switched to an alarm mode. In the alarm mode, first cell 38 displays an alarm hour, second cell 40 displays an alarm minute, and third cell 42 is blank. Fourth cell 44 displays the local current hour, fifth cell 46 displays the local current minute, and sixth cell 48 displays the local current second. Depression of down-count/AM/PM/24 Hour/alarm set and Celsius/Fahrenheit switch 60 in conjunction with up-count/compensation and alarm on/off switch 56 allows the operator to set the alarm hour, the alarm minute, and activate the alarm.

Upon a third depression of mode switch 54, clock 10 is switched to a global time mode and analog field 26 displays a preset global time in a preset global city. In the global time mode, first cell 38 displays the local current day, second cell 40 displays the local current month, while third cell 42 displays the local weekday. Fourth cell 44 displays the local current hour, while fifth cell 46 displays the local current minute, and sixth cell 48 displays the local current second. Depression of set switch 52 allows the operator to display the global time in a chosen global city or a chosen global time zone contained in ROM 20. More specifically, the operator can then utilize set switch 52 along with global indicators 30 to display the current hour and the phase of daylight in the chosen global city or the chosen global time zone. More specifically, utilizing up-count/compensation and alarm on/off switch 56 or down-count/AM/PM/24 Hour/alarm set and Celsius/Fahrenheit switch 60, the operator is able to select a geographic location so that the analog display 26 displays the global time for the selected location. In one embodiment, a full sun is displayed in a global indicator 30 for the selected location. The selected location may be altered by depressing switch 56 to advance the geographic location or switch 60 may be depressed to move in a reverse order through the locations.

For example, if the user is located in St. Louis, Mo. and desires to determine the time in Honk Kong, switch 56 is depressed until a full sun is display in global indicator 30 corresponding to Hong Kong, e.g., thirteen times, so that display 26 displays the current time in Hong Kong.

Upon a fourth depression of mode switch 54, clock 10 is switched to a temperature mode and analog field 26 displays the local time. In the temperature mode, first cell 38 is blank, second cell 40 displays a local temperature, and third cell 42 displays a "C" for Celsius or an "F" for Fahrenheit. Fourth cell 44 displays the local current hour, while fifth cell 46 displays the local current minute, and sixth cell 48 displays the local current second.

In one embodiment, clock 10 includes a built in temperature sensor (not shown), as known in the art, which determines the current temperature at the current location in either Celsius or Fahrenheit depending on the depression of down-count/AM/PM/24 Hour/alarm set and Celsius/Fahrenheit switch 60. More specifically, an output voltage of the sensor is electrically coupled to processor circuit 18 and a local temperature value determined.

When mode switch 54 is depressed a fifth time, clock 10 returns to the current time mode where analog field 26 displays the local time. Depression of light/snooze switch 58 triggers a back light for time display 16, and temporarily disengages the audible alarm signal built into clock 10. The values for cells 38, 40, 42, 44, 46, and 48 are adjusted for the current geographic location, or using the altered time zone, and displayed in numerical form, except the weekday and Celsius or Fahrenheit values for cell 42.

In one embodiment, clock 10 further includes a time signal receiver (not shown) configured to receive a transmitted time signal. In one embodiment, the transmitted time signal is transmitted from a transmitter located in Frankfurt, Germany, identified as DCF 77. In one embodiment, the time signal receiver locates and decodes the transmitted time signal to determine a received current time including an hour value, a minute value, a second values, a date value, and a year value. For example, utilizing the transmitted signal transmitted from DCF 77, a current time is determined for Germany.

In one embodiment, the current time generated by time generation circuit 14, specifically RTC 24, is compared to the decoded transmitted time. Based upon the comparison, any inaccuracy in the current time generated by RTC 24 is corrected. Such time signal receivers are well known in the art. In other embodiments, clock 10 may receive a transmitted time signal from a computer or a group of computers.

Clock 10 provides an accurate current time and calender week value for a current geographic location, while daylight is determined for various geographic locations around the world utilizing the simple and easy to read global time indicators 30.

While the invention has been described in terms of various specific embodiments, those skilled in the art will recognize that the invention can be practiced with modification within the spirit and scope of the claims.

What is claimed:

1. A global travel clock comprising:

a power source;

a time generation circuit electrically connected to said power source, said time generation circuit comprises a processor circuit utilized to determine a current time of a plurality of geographic locations, said current time comprising at least a calender week value; and a time display electrically collected to said time generation circuit and said power source, said time display comprising at least a calender week indicator for displaying said calender week value of a selected one of said geographic locations and a plurality of global time indicators each comprising at least one of a daylight phase, a leisure phase, and a sleep phase.

2. A clock in accordance with claim 1 wherein each said global time indicator comprises a geographic location name.

3. A clock in accordance with claim 1 wherein said time display further comprises a current time indicator.

4. A clock in accordance with claim 1 wherein said time display is a liquid crystal display.

5. A clock for displaying a current time of a selected geographic location, said clock comprising:

a power source;

a time generation circuit electrically connected to said power source, said time generation circuit comprising a real time clock and configured to generate a current time utilizing said real time clock, said current time comprising a calender week value of a selected geographic location; and a time display electrically connected to said time generation circuit and said power source, said time display configured to display said calender week value, said time display comprising a plurality of global time indicators, each said global time indicator comprising at least one of a daylight phase, a leisure phase, and a sleep phase.

6. A clock in accordance with claim 5 wherein said time generation circuit comprises a processor circuit, said processor circuit configured to determine at least said calender week value.

7. A clock in accordance with claim 6 wherein said processor circuit comprises a read only memory and a random access memory, said read only memory comprising data, said data comprising at least a plurality of offset times for various locations, calender week values for a predetermined number of years, and a number of days in a calender week, said random access memory configured to store reference data, and said processor circuit configured to determine a calender week value utilizing said read only memory data.

8. A clock in accordance with claim 5 wherein said time display comprises a current second indicator, a current minute indicator, a current hour indicator, a current day indicator, and a current year indicator.

9. A clock in accordance with claim 8 wherein said time display comprises a liquid crystal display, said liquid crystal display configured to display the current time for a current location.

10. A method for displaying a current time on a clock, the clock including a power source electrically corrected to a time generation circuit, and a time display electrically connected to the time generation circuit and the power source, the time display including at least one global time indicator, each global time indicator for a geographic location having at least one of a daylight phase, a leisure phase, and a sleep phase, said method comprising the steps of:

determining a current time utilizing the time generation circuit, the current time including at least a calender week value for a selected geographic location; and displaying the current time including the calender week value utilizing the time display wherein displaying the current time comprises displaying a current second, a current minute, a current hour, a current day, and a current year for a current geographic location and determining a current time for each geographic location, where if the current time for a geographic location is within a first time range, then displaying a daylight phase, if the current time for a geographic location is within a second time range, then displaying a leisure phase, and if the current time for a geographic location is within a third time range, then displaying a sleep phase.

11. A method in accordance with claim 10 wherein the time generation circuit includes a processor circuit including a read only memory, data including calender week values for a predetermined number of years stored in the read only memory, wherein determining a current time comprises the steps of:

obtaining the current time; and obtaining data from the read only memory.

12. A method in accordance with claim 11 wherein the time generation circuit further includes a real time clock electrically connected to the processor circuit, wherein obtaining the current time comprises the step of obtaining the current time from the real time clock.

13. A method in accordance with claim 11 wherein obtaining data from the read only memory comprises the step of obtaining a calender week value corresponding to the current time.

14. A method in accordance with claim 10 wherein the first time range is between 8:00 and 18:59:59.

15. A method in accordance with claim 10 wherein the second time range is between 19:00 and 23:59:59.

16. A method in accordance with claim 10 wherein the third time range is between 24:00 and 7:59:59.

17. A method in accordance with claim 10 wherein displaying a daylight phase comprises the step of displaying a full sun.

18. A method in accordance with claim 10 wherein displaying a sleep phase comprises the step of displaying a crescent moon.

* * * * *